US006960318B2

(12) United States Patent
Yoneda et al.

(10) Patent No.: US 6,960,318 B2
(45) Date of Patent: Nov. 1, 2005

(54) HIGH TEMPERATURE/HIGH PRESSURE VESSEL

(75) Inventors: Makoto Yoneda, Takasago (JP); Tomomitsu Nakai, Takasago (JP); Shigeo Kofune, Takasago (JP); Yutaka Narukawa, Takasago (JP); Takeshi Kanda, Takasago (JP); Takeo Nishimoto, Takasago (JP)

(73) Assignee: Kobe Steel, Ltd., Kobe (JP)

( * ) Notice: Subject to any disclaimer, the term of this patent is extended or adjusted under 35 U.S.C. 154(b) by 165 days.

(21) Appl. No.: 10/600,343

(22) Filed: Jun. 23, 2003

(65) Prior Publication Data

US 2004/0004314 A1 Jan. 8, 2004

(30) Foreign Application Priority Data

Jul. 8, 2002 (JP) ..... 2002-198619

(51) Int. Cl.[7] ..... C21D 1/06
(52) U.S. Cl. ..... 266/259; 266/252
(58) Field of Search ..... 266/259, 249, 266/252

(56) References Cited

U.S. PATENT DOCUMENTS 3,900,189 A 8/1975 Elmgren et al.
4,968,009 A 11/1990 Asari et al.

FOREIGN PATENT DOCUMENTS

JP 359155661 A * 9/1984

* cited by examiner

*Primary Examiner*—Scott Kastler
(74) *Attorney, Agent, or Firm*—Oblon, Spivak, McClelland, Maier & Neustadt, P.C.

(57) ABSTRACT

In a high temperature/high pressure vessel for treating a workpiece placed in the interior of the vessel at a high temperature and a high pressure wherein piano wire is wound under tension round an outer periphery of a cylindrical body to apply a compressive residual stress to the cylindrical body and axial openings of the cylindrical body are tightly closed with upper and lower lids so that the lids can be disengaged from the openings, the cylindrical body is constituted as a two-layer cylindrical body comprising an inner cylinder and an outer cylinder which is fitted on the inner cylinder through plural spacers arranged along an outer periphery surface of the inner cylinder, allowing cooling water flow paths to be formed each between adjacent such spacers so as to extend from one end side to an opposite end side of the tow-layer cylindrical body. In this high temperature/high pressure vessel, vessel packings can be cooled effectively, the piano wire is not wet with cooling water, and the internal space of the vessel can be utilized effectively.

14 Claims, 9 Drawing Sheets

HIGH TEMPERATURE/HIGH PRESSURE VESSEL

BACKGROUND OF THE INVENTION

1. Field of the Invention

The present invention relates to an improvement of a high temperature/high pressure vessel used for an HIP (hot isostatic pressing) apparatus and more particularly to a high temperature/high pressure vessel with piano wire wound under tension round an outer periphery of a cylindrical body of the vessel.

2. Description of the Related Art

For pressure sintering of various powdery materials such as powdered metals and ceramics, for removing internal defects of cast products and sintered products, and for diffusion bonding, an HIP apparatus which utilizes a synergistic effect of a high isotropic pressure and a high temperature within a high pressure vessel is adopted in various industrial fields. The HIP apparatus is composed of a high temperature/high pressure vessel (with a heat insulating layer and a heater disposed in the interior thereof) into which a high pressure gas is sealed, an upper lid and a lower lid for closing upper and lower openings, respectively, of the vessel, and a press frame which bears an axial force acting on the upper and lower lids. As known examples of a high temperature/high pressure vessel used in such an HIP apparatus and with a refrigerant flow path formed in a cylindrical body thereof there are mentioned those disclosed in U.S. Pat. No. 3,900,189 (prior art 1) and U.S. Pat. No. 4,968,009 (prior art 2).

From the standpoint of cooling effect, the thinner the cylindrical body, the better. However, in point of strength, it is impossible to thin the cylindrical body beyond a certain level. Therefore, in the prior art 1, particularly in the case of a large-sized high temperature/high pressure vessel, it is difficult to effectively cool portions where vessel packings are disposed. As a result of the temperature of the vessel packings becoming high, the life thereof becomes short, thus causing an increase of running cost. Moreover, if the prior art 1 is of a construction wherein piano wire is wet with cooling water, the piano wire rusts, causing breaking of the wire; besides, a fatigue life of the piano wire becomes shorter. In case of a thin plate being interposed between a rod-like spacer and piano wire, the thin plate undergoes shrinkage deformation due to winding of the piano wire and there is a fear that the sealing function of a seal which prevents the permeation of cooling water may be lost.

In the prior art 2, a cooling jacket is mounted in the interior of a high pressure vessel, so that the size of a heater installed within the same vessel becomes smaller and so does the size of a workpiece. In other words, it is necessary to increase the size of the high pressure vessel, which causes an increase of cost and is therefore not desirable from the economic point of view.

SUMMARY OF THE INVENTION

It is an object of the present invention to provide a high temperature/high pressure vessel capable of cooling vessel packings effectively, capable of preventing piano wire from being wet with cooling water, and further capable of utilizing an internal space of the vessel effectively.

A first means which the present invention has adopted for solving the above-mentioned problems is a high temperature/high pressure vessel for treating a workpiece placed in the interior of the vessel at a high temperature and a high pressure, the vessel comprising a cylindrical body, with piano wire wound under tension round an outer periphery of the cylindrical body, and lid members which tightly close axial openings of the cylindrical body so as to be disengageable from the openings. The cylindrical body comprises an inner cylinder, plural spacers arranged along an outer periphery surface of the inner cylinder, and an outer cylinder fitted on the inner cylinder through the spacers. Cooling water flow paths extending from one end side to an opposite end side of the cylindrical body are formed each between adjacent such spacers.

The high temperature/high pressure vessel of the first means constructed as above is superior to the prior art 1 in the following points.

① High pressure sealing rings (high pressure packings) can be cooled more effectively than in the prior art 1, resulting in the life thereof being prolonged, and thus there accrues an advantage in point of running cost of an HIP apparatus which uses the high temperature/high pressure vessel.

② Unlike the prior art 1, piano wire is not wetted with cooling water, that is, piano wire does not rust which would cause breaking of the wire, and therefore a fatigue life of the piano wire can be prolonged.

③ There does not occur such a deformation of an inner cylinder caused by winding of piano wire as in the prior art 1 wherein a thin plate is interposed between rod-like spacers and piano wire. Thus, there does not occur a deformation-based loss of the sealing function of sealing rings which are for preventing the permeation of cooling water.

The high temperature/high pressure vessel of the first means constructed as above is superior to the prior art 2 in the following points.

① A cooling jacket is not installed within the high pressure vessel. Therefore, a heater installed within the high pressure vessel is not required to be smaller in size, nor is so required as to a workpiece, either. Thus, it is not necessary to make the high pressure vessel larger in size. This is economical.

② Unlike a cooling jacket of a two-layer construction comprising inner and outer jackets and with a refrigerant flow path formed in one of the inner and outer jackets, there is no fear of cracking in the inner and outer cylinders of the cylindrical body due to stress concentration.

In this high temperature/high pressure vessel according to the present invention, the outer cylinder may be constructed such that, after being fitted along outer peripheries of the spacers in a state of a high temperature, it shrinks and deforms as the temperature drops.

Or in this high temperature/high pressure vessel according to the present invention, the outer cylinder may be constructed such that, after being fitted along outer peripheries of the spacers, it is shrunk and deformed by winding of the piano wire therearound.

In this high temperature/high pressure vessel according to the present invention, the spacers may be constructed so as to be fixed to the outer periphery surface of the inner cylinder by means of a clamp member fitted in each of outer grooves and having a thickness not larger than the depth of the outer grooves, the outer grooves being formed in the spacers in a direction orthogonal to the spacers.

This high temperature/high pressure vessel according to the present invention may be constructed such that a cooling water supply header for the supply of cooling water to the cooling water flow paths is disposed in a watertight manner on one end side of the cylindrical body, while on an opposite end side of the cylindrical body is disposed also in a watertight manner a cooling water collecting header for the collection of cooling water flowing out from the cooling water flow paths. The cooling water supply header and the cooling water collecting header may be constructed in a removable manner. By so doing, even if there should occur leakage of cooling water due to damage of a sealing ring or due to material deterioration, the sealing ring can be replaced easily by removing such cooling water collecting header or cooling water supply header, with consequent shortening of the maintenance time permitting improvement in availability of the HIP apparatus which uses the high temperature/high pressure vessel and contribution to the reduction of maintenance cost.

Further, this high temperature/high pressure vessel according to the present invention may be constructed such that the piano wire is wound round an outer periphery of the outer cylinder through spacer pieces, with leakage water guide paths being formed transversely outwards of the spacer pieces to guide leakage water leaking from the cooling water flow paths toward an end portion of the cylindrical body, and leakage water detecting means are provided in the leakage water guide paths. By detecting leakage water with use of the leakage water detecting means, it is possible to become aware that a crack has been developed in the outer cylinder and hence possible to prevent the occurrence of a serious accident caused by cracking of the outer cylinder.

The second means which the present invention has adopted for solving the foregoing problems is a high temperature/high pressure vessel for treating a workpiece placed in the interior of the vessel at a high temperature and a high pressure, the vessel comprising a cylindrical body, lid members which tightly close axial openings of the cylindrical body so as to be disengageable from the openings, plural spacers arranged along an outer periphery surface of the cylindrical body, and cooling water pipes each interposed between adjacent such spacers and extending from one to the other end side of the cylindrical body, with piano wire being wound under tension round outer peripheries of the spacers.

The high temperature/high pressure vessel of the second means constructed as above is superior to the prior art 1 in the following points.

① Unlike the prior art 1, piano wire is not wetted with cooling water, that is, the piano wire does not rust which would cause breaking of the wire, and therefore a fatigue life of the piano wire can be prolonged.

② There does not occur such a deformation of the cylindrical body caused by winding of piano wire as in the prior art 1 wherein a thin plate is interposed between rod-like spacers and piano wire. Thus, the sealing function of sealing rings for preventing the permeation of cooling water is not lost.

The high temperature/high pressure vessel of the second means constructed as above is superior to the prior art 2 in the following points.

① A cooling jacket is not installed within the high pressure vessel. Therefore, a heater installed within the high pressure vessel is not required to be smaller in size, nor is so required as to a workpiece, either. Thus, it is not necessary to make the high pressure vessel larger in size. This is economical.

② Unlike a cooling jacket of a two-layer construction comprising inner and outer jackets and with a refrigerant flow path formed in one of the inner and outer jackets, there is no fear of cracking in the cylindrical body due to stress concentration.

This high temperature/high pressure vessel according to the present invention may be constructed such that the cooling water pipes are brought into close contact with the outer periphery surface of the cylindrical body by their deformation caused by the winding of the piano wire.

This high temperature/high pressure vessel according to the present invention may be constructed such that a heat conductive material is filled between an outer periphery surface of an inner cylinder of the cylindrical body and the cooling water pipes and also between the cooling water pipes and the spacers.

Further, in this high temperature/high pressure vessel according to the present invention, the spacers may be formed as flat bars. In this case, the flat bars used as spacers have a shape easy to obtain and therefore can contribute to the reduction of cost of the high temperature/high pressure vessel.

DESCRIPTION OF THE PREFERRED EMBODIMENTS

Figure 1:
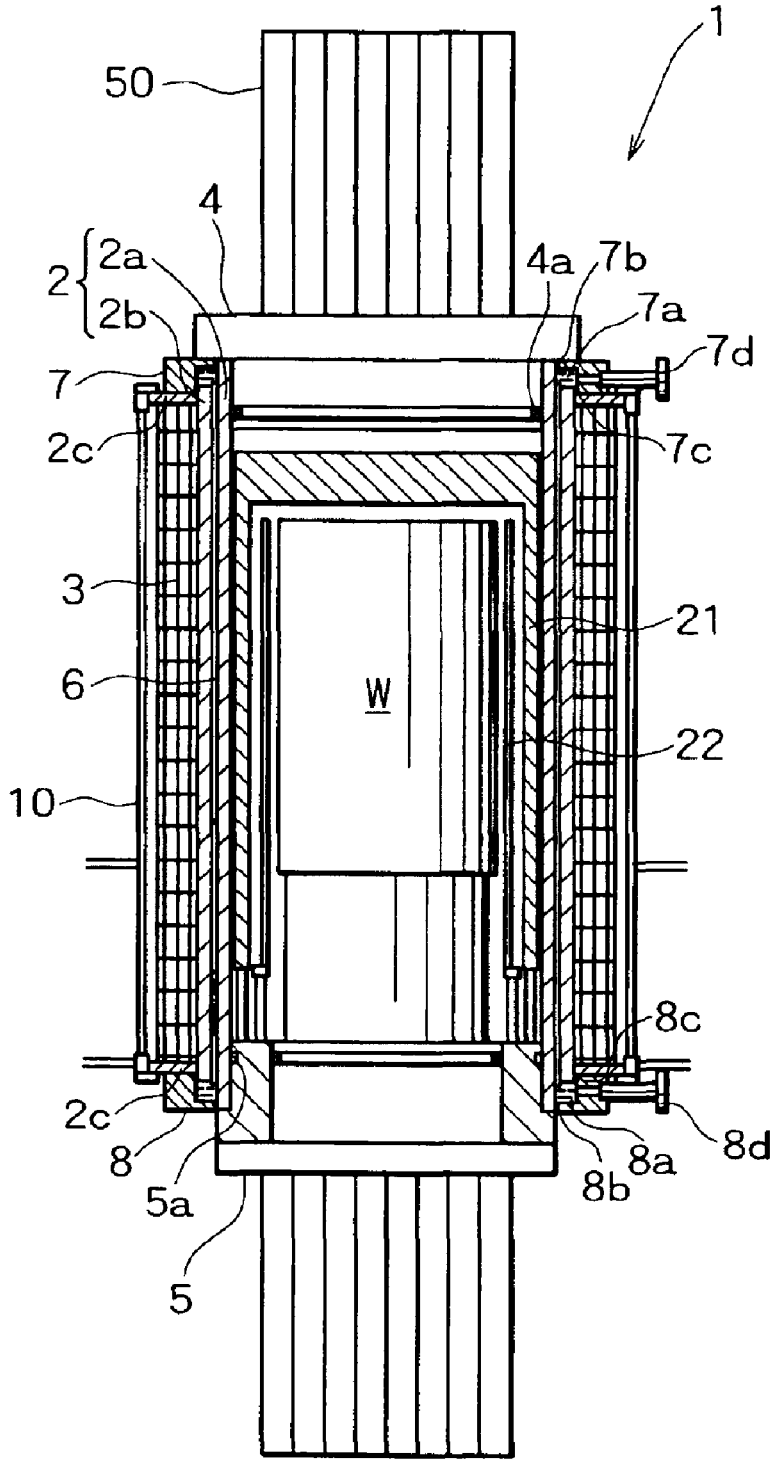
FIG. 1 is a vertical sectional view of a high temperature/high pressure vessel according to an embodiment 1 of the present invention as installed within a press frame.
Figure 2:
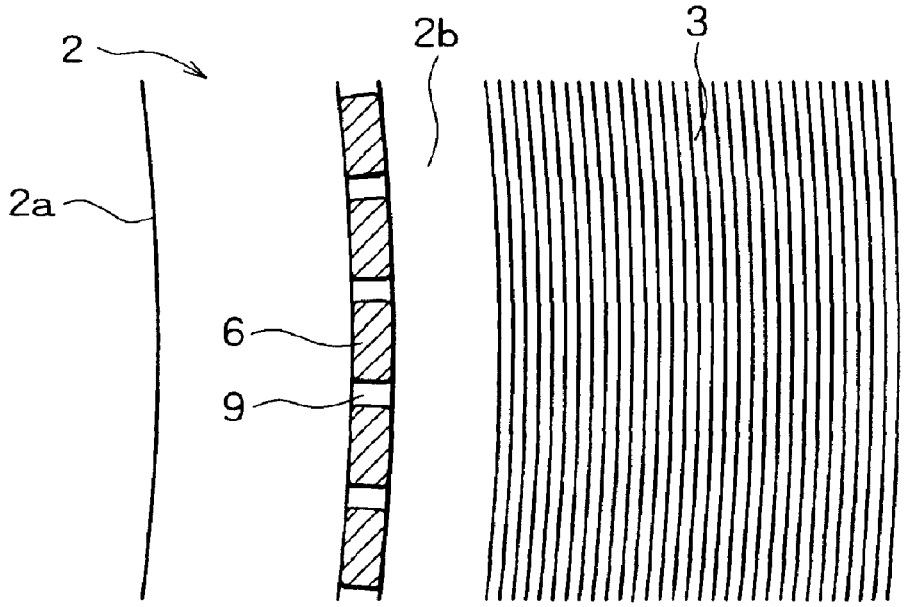
FIG. 2 illustrates a part of a cross section of the high temperature/high pressure vessel of the embodiment 1.

A high temperature/high pressure vessel according to an embodiment 1 of the present invention will be described hereinunder with reference to the accompanying drawings. FIG. 1 is a vertical sectional view of the high temperature/high pressure vessel as installed within a press frame and FIG. 2 illustrates a part of a cross section of the high temperature/high pressure vessel.

In those figures, the reference numeral 1 denotes the high temperature/high pressure vessel which is installed within a press frame 50 removably. The high temperature/high pressure vessel 1 is provided with a cylindrical body 2 of a construction to be described later and piano wire 3 wound under a predetermined tension round an outer periphery surface of the cylindrical body 2. An upper opening of the cylindrical body 2 is hermetically sealed by fitting therein of an upper lid 4, the upper lid 4 having a high pressure sealing ring 4*a* as a high pressure packing fitted in a sealing ring groove, while a lower opening of the cylindrical body 2 is hermetically sealed by fitting therein of a lower lid 5, the lower lid 5 having a sealing ring 5*a* fitted in a sealing ring groove. In the space formed between the upper and lower lids 4, 5 of the cylindrical body 2 there is disposed a cylindrical heat insulating layer 21 having a top lid, and inside the heat insulating layer 21 is disposed a heater 22 for treating a workpiece W. The lower lid 5 is composed of a lower top lid for supporting the heat insulating layer 21 and a lower bottom lid fitted with the lower top lid through a high pressure sealing ring and supporting the workpiece W.

The cylindrical body 2 is of a two-layer structure. More specifically, it comprises an inner cylinder 2*a* and an outer cylinder 2*b* fitted on the inner cylinder 2*a* through plural spacers 6, the spacers 6 being flat bars and arranged axially along an outer periphery surface of the inner cylinder 2*a* and spacedly at predetermined intervals in the circumferential direction. An axial length passing through a diametrical center of the inner cylinder 21 is set larger than axial length passing through a diametrical center of the outer cylinder 2*b* and is projecting from end portions of the outer cylinder 2*b*. A cooling water collecting header 7 to be described later is fitted removably on the upper projecting portion of the inner cylinder 2*a* projecting from the upper end of the outer cylinder 2*b*, while a cooling water supply header 8 to be described later is fitted removably on the lower projecting portion of the inner cylinder 2*a* projecting from the lower end of the outer cylinder 2*b*. The outer cylinder 2*b* is provided at both ends thereof with wire winding flanges 2*c*, and the piano wire 3 is wound between both wire winding flanges 2*c*.

The cooling water collecting header 7 is formed annularly and an inner groove serving as a cooling water chamber 7*a* is formed circumferentially in the header 7 on the side where the header 7 is fitted on the inner cylinder 2*a*. A sealing ring groove is formed circumferentially below the cooling water chamber 7*a* and on the side where the header 7 is fitted on the inner cylinder 2*a*, and a sealing ring 7*b* is fitted in the sealing ring groove. Further, a sealing ring groove is formed circumferentially in a portion of the cooling water collecting header 7 where the header is in contact with an upper end face of the outer cylinder 2*b*, and a sealing ring 7*c* is fitted therein.

The cooling water supply header 8 is formed annularly and an inner groove serving as a cooling water chamber 8*a* is formed in the header 8 on the side where the header 8 is fitted on the inner cylinder 2*a*. A sealing ring groove is formed circumferentially below the cooling water chamber 8*a* and on the side where the header 8 is fitted on the inner cylinder 2*a*, and a sealing ring 8*b* is fitted therein. Further, a sealing ring groove is formed circumferentially in a portion of the cooling water supply header 8 where the header 8 is in contact with a lower end face of the outer cylinder 2*b*, and a sealing ring 8*c* is fitted therein. As will be seen from the above description, the cooling water collecting header 7 and the cooling water supply header 8 are of the same construction and are fitted in the end portion of the inner cylinder 2*a* in a mutually inverted state vertically.

The cooling water chamber 7*a* in the cooling water collecting header 7 and the cooling water chamber 8*a* in the cooling water supply header 8 are in communication with each other through gaps each formed between adjacent spacers 6. That is, in the high temperature/high pressure vessel 1 of this embodiment 1, the gaps each formed between adjacent spacers 6 serve as cooling water flow paths 9. Therefore, cooling water flowing into the cooling water chamber 8*a* from a water inlet port 8*d* which projects from an outer periphery of the cooling water supply header 8 flows through the cooling water flow paths while absorbing heat from the inner cylinder 2*a*, then enters the cooling water chamber 7*a* in the cooling water collecting header 7, then passes through a drain port 7*d* projecting from an outer periphery of the header 7, and is drained through a drain pipe (not shown) with a safety valve disposed therein. The cooling water is used in a circulative manner.

In this embodiment 1, the spacers 6 are deformed along the outer periphery surface of the inner cylinder 2*a* by the following method. Spacer fixing flanges are fitted in both-end openings of the inner cylinder 2*a* and, using fixing pins or bolts for example, end portions of the spacers 6 are fixed to the spacer fixing flanges at predetermined intervals in the circumferential direction of the outer periphery surface of the inner cylinder 2*a*. Then, the outer cylinder 2*b* is fitted on outer peripheries of the spacers 6 thus fixed to the inner cylinder 2*a* and piano wire 3 is wound round an outer periphery of the outer cylinder 2*b*, allowing the spacers 6 to be deformed along the outer periphery surface of the inner cylinder 2*a* due to shrinkage of the outer cylinder 2*b*.

After the end of winding of the piano wire, the fixing pins or bolts are removed and at the same time the spacer fixing flanges are removed. According to this method, heating energy for the outer cylinder 2*b* is not necessary and therefore the number of working steps is reduced. Thus, this method is superior in point of shortening of the delivery period and energy saving in comparison with the method wherein the outer cylinder 2*b* is heated for shrink fitting.

It is a vessel support structure 10 that engages outer faces of end portions of the wire winding flanges 2*c* and enclose the whole of the piano wire 3. The vessel support structure 10 holds the high temperature/high pressure vessel 1.

A description will now be given of the operation of the high temperature/high pressure vessel 1 constructed as above. For treating the workpiece W in the high temperature/high pressure vessel 1, the vessel is cooled with cooling water. More specifically, when cooling water containing a rust preventive agent is fed from the water inlet port 8*d* into the cooling water chamber 8*a* in the cooling water supply header 8, the cooling water is equally distributed by the cooling water chamber 8*a*, flows into the cooling water flow paths 9, and flows from below to above through the cooling water flow paths 9 while undergoing heat exchange, whereby the inner cylinder 2*a* and the outer cylinder 2*b* of the cylindrical body 2 are cooled effectively.

The cooling water which has become high in temperature by heat exchange flows into the cooling water collecting header 7 and is drained to the exterior through the drain port 7*d*.

As described above, the cylindrical body 2 of the high temperature/high pressure vessel 1 according to this embodiment 1 is of a double construction comprising the inner cylinder 2*a* and the outer cylinder 2*b*, the inner cylinder 2*a* being smaller in wall thickness than the cylindrical body 2. Therefore, the high temperature/high pressure vessel 1 of this embodiment 1 is superior to the prior art 1 in the following points.

① The high pressure sealing rings 4*a* and 5*a* can be cooled more effectively than in the prior art 1 and their lives are prolonged, so that there accrues an advantage in point of running cost of HIP apparatus which uses the high temperature/high pressure vessel 1.

② Unlike the prior art 1, piano wire 3 is not wetted with cooling water, that is, piano wire 3 does not rust which would cause breaking of the wire, and therefore a fatigue life of the piano wire 3 can be prolonged.

③ There does not occur such a deformation of the inner cylinder 2*a* caused by winding of piano wire 3 as in the prior art 1 wherein a thin plate is interposed between rod-like spacers and piano wire. Thus, there does not occur a deformation-based loss of the sealing function of sealing rings which are for preventing the permeation of cooling water.

The high temperature/high pressure vessel 1 of this embodiment 1 is superior to the prior art 2 in the following points.

① A cooling jacket is not installed within the high pressure vessel. Therefore, a heater installed within the high pressure vessel is not required to be smaller in size, nor is so required as to a workpiece, either. Thus, it is not necessary to make the high pressure vessel larger in size. This is economical.

② Unlike a cooling jacket of a two-layer construction comprising inner and outer jackets and with a refrigerant flow path formed in one of the inner and outer jackets, there is no fear of cracking in the inner and outer cylinders of the cylindrical body due to stress concentration.

Besides, in the high temperature/high pressure vessel 1 of this embodiment 1, both cooling water collecting header 7 and cooling water supply header 8 are constructed removably as noted earlier.

Therefore, even if there should occur the leakage of cooling water due to damage of sealing rings or material deterioration, the sealing rings can be replaced easily by removing the cooling water collecting header 7 and the cooling water supply header 8, whereby the maintenance time is shortened. Consequently, it is possible to improve the availability of HIP apparatus which uses the high temperature/high pressure vessel 1 and contribute to the reduction of maintenance cost.

In the high temperature/high pressure vessel 1 of this embodiment 1, moreover, even if there should occur cracking of the inner cylinder 2*a*, there is no fear of breakage of the entire cylindrical body 2, but the safety valve disposed in the drain pipe connected to the drain port 7*d* operates, so that the occurrence of cracking of the inner cylinder 2*a* can be detected easily. Further, if the outer cylinder 2*b* is cracked, cooling water will leak out, so the occurrence of cracking in the outer cylinder 2*b* can be known easily by detecting such leaking cooling water.

Figure 3:
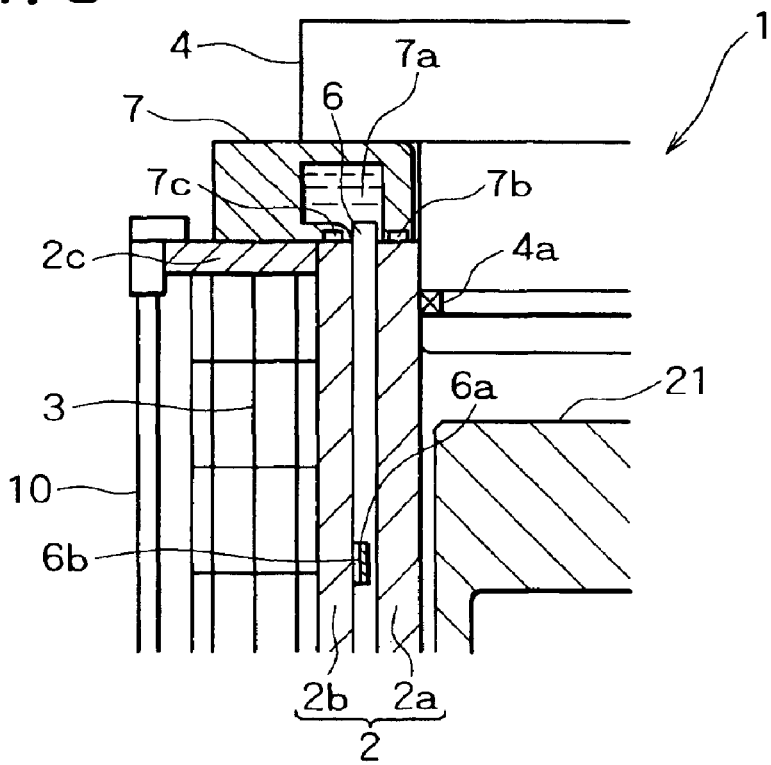
FIG. 3 is a vertical sectional view showing a part of an upper portion and the vicinity thereof of a high temperature/high pressure vessel according to an embodiment 1a of the present invention.

A high temperature/high pressure vessel according to an embodiment 1a of the present invention will be described below with reference to FIG. 3 which is a vertical sectional view showing a part of an upper portion and the vicinity thereof of the vessel. In this embodiment 1a, the same components and those having the same functions as in the embodiment 1 will be identified by the same reference numerals. However, as to a cooling water collecting header and a cooling water supply header, both are completely the same in construction, provided both are assembled in a mutually inverted state vertically. Therefore, as to the header construction, reference will be made below to only the water collecting header as an example.

In the high temperature/high pressure vessel 1 of this embodiment 1*a*, an inner cylinder 2*a* and an outer cylinder 2*b* of a cylindrical body 2 are equal in axial length. A cooling water collecting header 7 is formed annularly, and in the interior thereof is circumferentially formed an inner groove serving as a cooling water chamber 7*a* which opens to an end face side of the inner and outer cylinders 2*a*, 2*b*. Two sealing ring grooves are formed circumferentially below the cooling water chamber 7*a* and on the side where the header 7 is in contact with both inner and outer cylinders 2*a*, 2*b*, and sealing rings 7*b* and 7*c* are fitted in the sealing ring grooves respectively.

In the high temperature/high pressure vessel 1 constructed as above, the inner and outer cylinders 2*a*, 2*b* of the cylindrical body 2 and spacers 6 are assembled in the following manner. As to the cylindrical body 2, plural spacers 6 are arranged axially along an outer periphery surface of the inner cylinder 2*a* and at predetermined intervals in the circumferential direction so that outer grooves 6*a* formed in the spacers 6 in a direction orthogonal to the spacers face outward. Then, a clamp member 6*b* having a thickness not larger than the depth of the outer grooves 6*a* is fitted in each of the outer grooves to clamp and fix the spacers 6 to the inner cylinder 2*a*. Further, the outer cylinder 2*b* heated to a predetermined temperature is fitted on outer peripheries of the spacers 6 thus fixed to the inner cylinder 2*a*.

In this case, the outer cylinder 2*b* shrinks as the temperature drops and the spacers 6 formed as flat bars are curved so as to follow the profile of the outer periphery surface of the inner cylinder 2*a*. By adopting such a method, a spacer material of an easily available shape is employable and it is not necessary to form the spacers 6 beforehand so as to follow the outer periphery profile of the inner cylinder 2*a*. Thus, it is possible to make contribution to the reduction of cost of the high temperature/high pressure vessel. Further, by winding the piano wire 3 round the outer cylinder 2*b* there accrues an effect such that a large compressive residual stress can be applied to the inner cylinder 2*a* in comparison with a mere winding of the piano wire 3.

As in the first embodiment, for deforming the spacers 6 so as to follow the outer periphery profile of the inner cylinder 2*a*, there also may be adopted a method wherein the outer cylinder 2*b* is fitted on the spacers 6 fixed to the inner cylinder 2*a*, thereafter the piano wire 3 is wound round the outer periphery of the outer cylinder 2*b*, and the spacers 6 are allowed to shrink so as to follow the outer periphery profile of the inner cylinder 2*a* due to shrinkage of the outer cylinder 2*b*. According to this method, heating energy for the outer cylinder 2*b* is not needed and the number of working steps is reduced. Thus, this method is advantageous in point of shortening of the delivery period and energy saving over the foregoing method wherein the outer cylinder 2*b* is heated.

Since the high temperature/high pressure vessel 1 of this embodiment 1a is of a construction wherein cooling water flows through cooling water flow paths each formed between adjacent ones of the spacers 6 which are interposed between the inner cylinder 2*a* and the outer cylinder 2*b*, thereby cooling the cylindrical body 2 effectively, there can be obtained the same effects as in the embodiment 1.

Figure 4:
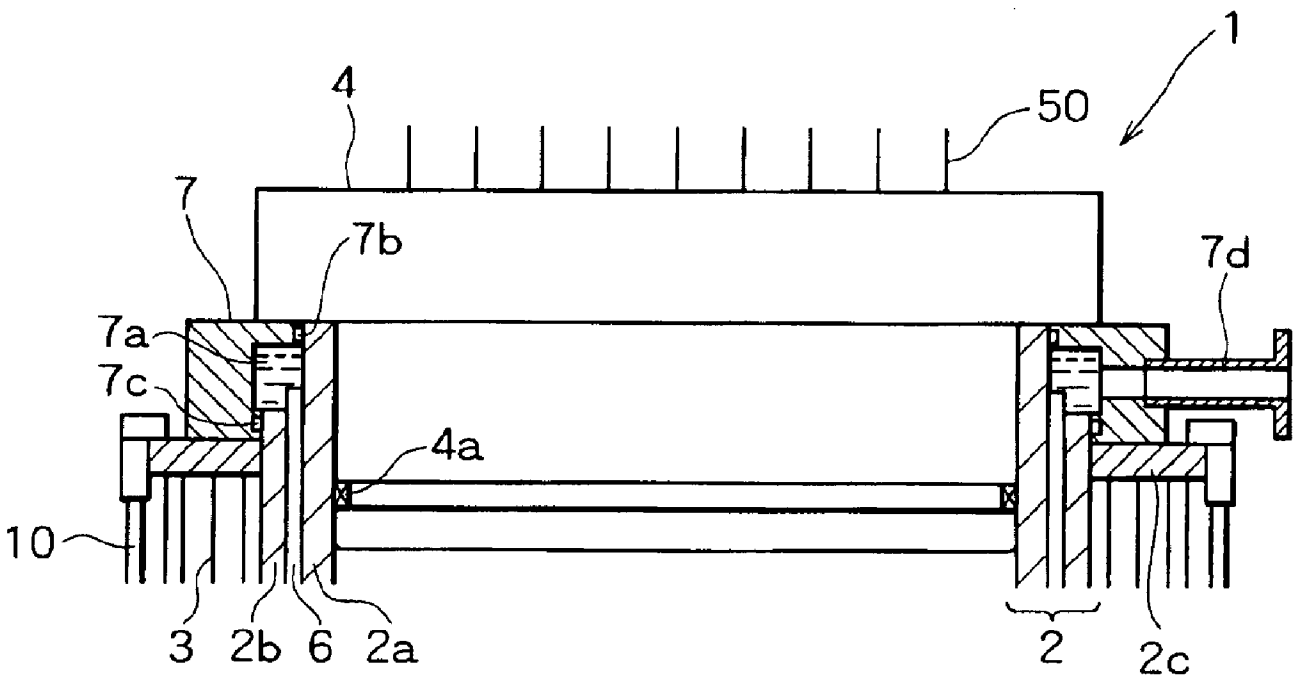
FIG. 4 is a vertical sectional view of an upper portion and the vicinity thereof of a high temperature/high pressure vessel according to an embodiment 1b of the present invention.

A high temperature/high pressure vessel according to an embodiment 1b of the present invention will be described below with reference to FIG. 4 which is a vertical sectional view of an upper portion and the vicinity thereof of the vessel. In this embodiment 1*b*, the same components and those having the same functions as in the embodiment 1 will be identified by the same reference numerals. As to a cooling water collecting header and a cooling water supply header, both are completely the same in construction, provided both are assembled in a mutually inverted state vertically. Therefore, as to the header construction, reference will be made below to only the cooling water collecting header as an example.

In the high temperature/high pressure vessel 1 of this embodiment 1*b*, as in the embodiment 1, an axial length of an inner cylinder 2*a* of a cylindrical body 2 is set larger than that of an outer cylinder 2*b*. A cooling water collecting header 7 is formed annularly, and in the interior thereof is circumferentially formed an inner groove serving as a cooling water chamber 7*a* which opens to an outer periphery surface side of the inner cylinder 2*a*. Above the cooling water chamber 7*a* is formed a sealing ring groove circumferentially and a sealing ring 7*b* which is in close contact with the outer periphery surface of the inner cylinder 2*a* is fitted in the sealing ring groove. Likewise, below the cooling water chamber 7*a* is formed a sealing ring groove circumferentially and a sealing ring 7*c* which is in close contact with an outer periphery surface of the outer cylinder 2*b* is fitted in the sealing ring groove.

Since the high temperature/high pressure vessel 1 of this embodiment 1b is of a construction wherein cooling water flows through cooling water flow paths each formed between adjacent ones of spacers 5 which are interposed between the inner and outer cylinders 2*a*, 2*b*, thereby cooling the cylindrical body 2 effectively, there can be obtained the same effects as in the embodiment 1.

Figure 5:
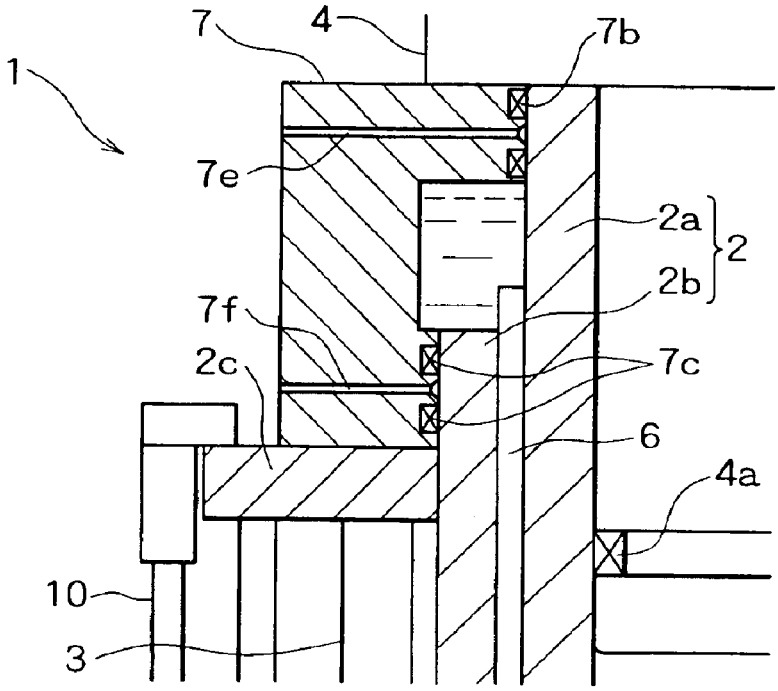
FIG. 5 is a vertical sectional view showing a part of an upper portion and the vicinity thereof of a high temperature/high pressure vessel according to an embodiment 1c of the present invention.

A high temperature/high pressure vessel according to an embodiment 1c of the present invention will be described below with reference to FIG. 5 which is a vertical sectional view showing a part of an upper portion and the vicinity thereof of the vessel. In this embodiment 1c, the same components and those having the same functions as in the embodiment 1b will be identified by the same reference numerals. However, as to a cooling water collecting header and a cooling water supply header, both are completely the same in construction, provided both are assembled in a mutually inverted state vertically. As to the header construction, therefore, reference will be made below to only the cooling water collecting header as an example.

A difference between a cooling water collecting header 7 used in the high temperature/high pressure vessel 1 of this embodiment 1c and the cooling water collecting header 7 in the previous embodiment 1b resides in whether a leakage water detecting port for detecting the leakage of cooling water is present or not. More specifically, two sealing ring grooves are formed circumferentially above a cooling water chamber 7*a* in the cooling water header 7 and sealing rings 7*b* which are in close contact with an outer periphery surface of an inner cylinder 2*a* are fitted in the two sealing ring grooves respectively. Likewise, two sealing ring grooves are formed circumferentially below the cooling water chamber 7*a* and sealing rings 7*c* which are in close contact with an outer periphery surface of an outer cylinder 2*b* are fitted in the two sealing ring grooves respectively.

A leakage water detecting port 7*e* for detecting the leakage of cooling water from the sealing ring 7*b* located on the cooling water chamber 7*a* side is formed between the sealing ring grooves with the sealing rings 7*b* fitted therein and extends into communication with an outer periphery surface of the cooling water collecting header 7. Likewise, a leakage water detecting port 7*f* for detecting the leakage of cooling water from the sealing ring 7*c* located on the cooling water chamber 7*a* side is formed and extends into communication with the outer periphery surface of the cooling water collecting header 7.

Since the high temperature/high pressure vessel 1 of this embodiment 1c is of a construction wherein cooling water flows through cooling water flow paths each formed between adjacent ones of spacers 6 which are interposed between the inner and outer cylinders 2*a*, 2*b*, it is possible to obtain the same effects as in the previous embodiment 1b. Additionally, there also is obtained an effect such that by detecting the cooling water flowing out of the leakage water detecting ports 7*e* and 7*f* it is possible to surely know when the sealing rings 7*b* and 7*c* located on the cooling water chamber 7*a* are to be replaced. That is, by replacing the sealing rings 7*b* and 7*c* upon detection of cooling water leakage it is possible to minimize the wetting of piano wire 3 with cooling water.

Figure 6:
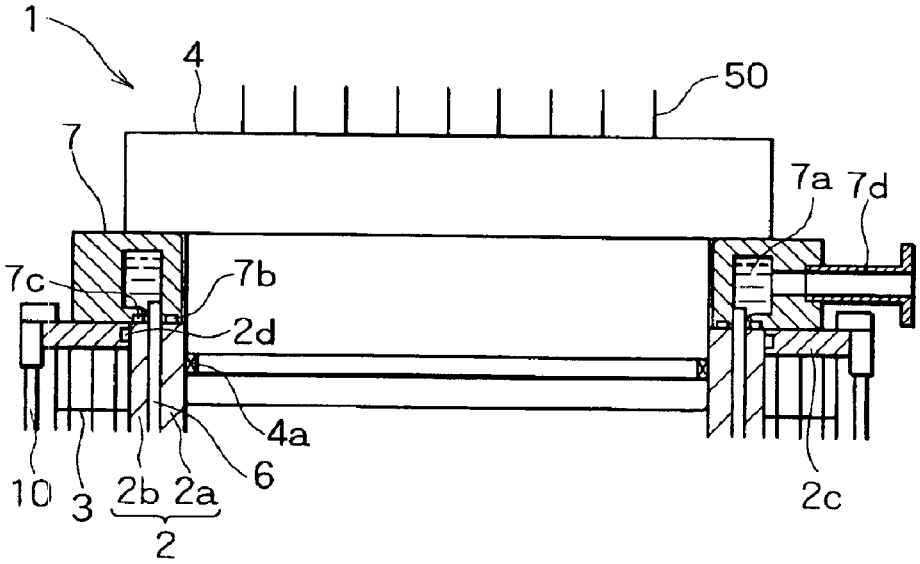
FIG. 6 is a vertical sectional view of an upper portion and the vicinity thereof of a high temperature/high pressure vessel according to an embodiment 1d of the present invention.

A high temperature/high pressure vessel according to an embodiment 1 d of the present invention will be described below with reference to FIG. 6 which is a vertical sectional view showing an upper portion and the vicinity thereof of the vessel. In this embodiment 1d, the same components and those having the same functions as in the embodiment 1 will be identified by the same reference numerals. However, as to a cooling water collecting header and a cooling water supply header, both are completely the same in construction, provided both are assembled in a mutually inverted state vertically. Therefore, as to the header construction, reference will be made below to only the water collecting header as an example.

A cooling water collecting header 7 used in a high temperature/high pressure vessel according to this embodiment 1d is of the same construction as the cooling water collecting header 7 used in the high temperature/high pressure vessel of the embodiment 1a except that a sealing ring 2*d* is disposed in the portion where a wire winding flanges 2*c* is fitted on the outer cylinder 2*b*.

Since the high temperature/high pressure vessel 1 of this embodiment 1 d is of a construction wherein cooling water flows through cooling water flow paths each formed between adjacent ones of spacers 6 which are interposed between inner and outer cylinders 2*a*, 2*b*, thereby cooling the cylindrical body 2 effectively, it is possible to obtain the same effects as in the embodiment 1b. Additionally, even if the sealing function of the sealing ring 7*c* which is in contact with an end face of the outer cylinder 2*b* becomes deteriorated and cooling water present in the cooling water chamber 7*a* leaks out from the sealing ring 7*c*, the entry of cooling water into the winding portion of piano wire 3 can be prevented by the sealing ring 2*d*. Consequently, the piano wire 3 can be surely prevented from being wet with cooling water.

Figure 7A:
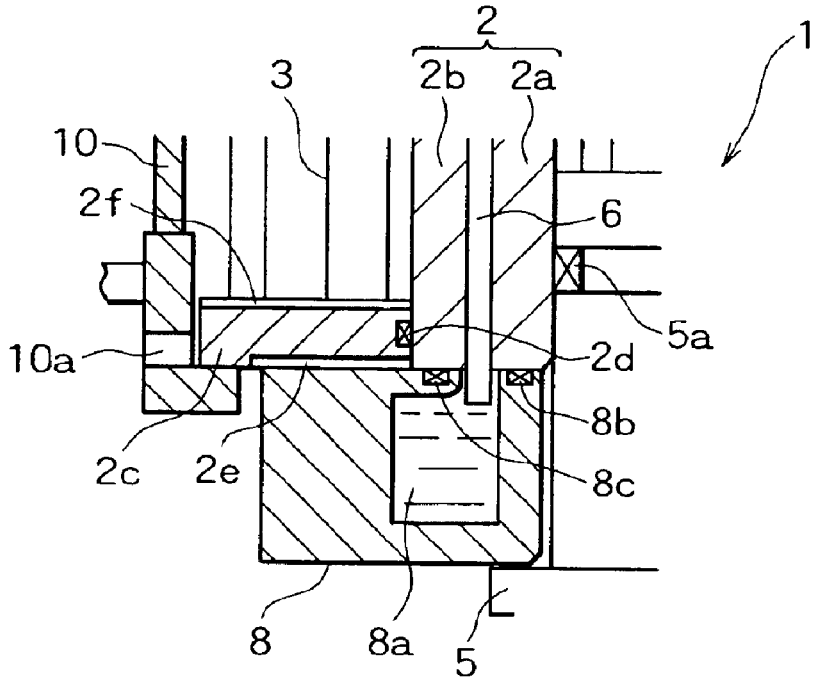
FIG. 7(*a*) is a vertical sectional view showing a part of a lower portion and the vicinity thereof of a high temperature/high pressure vessel according to an embodiment 1e; of the present invention and FIG. 7(*b*) illustrates a part of a cross section of the high temperature/high pressure vessel of the embodiment 1e.
Figure 7B:
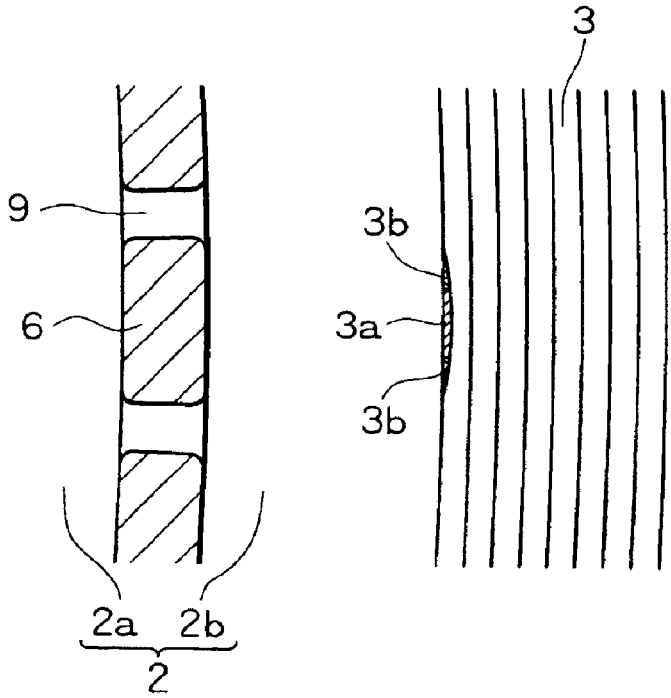

A high temperature/high pressure vessel according to an embodiment 1 e of the present invention will be described below with reference to FIG. 7(*a*) which is a vertical sectional view showing a part of a lower portion and the vicinity thereof of the vessel and FIG. 7(*b*) which illustrates a part of a cross section of the vessel. In this embodiment 1e, the same components and those having the same functions as in the embodiment 1 will be identified by the same reference numerals. However, as to a cooling water collecting header and a cooling water supply header, both the completely the same in construction, provided both are assembled in a mutually inverted state vertically. Therefore, as to the header construction, reference will be made below to the cooling water supply header as an example.

A cooling water supply header 8 used in the high temperature/high pressure vessel 1 of this embodiment 1e is of the same construction as the cooling water supply header used in the high temperature/high pressure vessel of the embodiment 1d, with a difference residing in whether cooling water leakage detecting means are provided on an outer side face and a piano wire winding side face of a wire winding flange 2*c*. To be more specific, an outer detecting groove 2*e* for detecting the leakage of cooling water through a sealing ring 8*c* from the interior of a cooling water chamber 8*a* in the cooling water supply header 8 is formed in an outer side, i.e., a lower surface, of the wire winding flange 2*c*. In this case, as will be seen from the drawing, a cooling water detecting path is formed by both an upper surface of the cooling water supply header 8 and the outer detecting groove 2*e*.

This high temperature/high pressure vessel 1 is provided with leakage water detecting means which causes leaking cooling water to flow out to an outer position permitting visual checking of the leakage water to detect the occurrence of a crack, if any, in the outer cylinder 2*b*. This leakage water detecting means is composed of an inner detecting groove 2*f* formed inside, i.e., in an upper surface, of the wire winding flange 2*c* and a leakage water detecting port 10*a* formed near a lower end of the vessel support structure 10, the port 10*a* causing the leakage water flowing through the inner detecting groove 2*f* to flow out to the outer position. Leakage water leaking out from the cooling water flow paths is guided to the inner detecting groove 2*f* through leakage water guide paths 3*b* to be described later. As shown in FIG. 7(*b*), the piano wire 3 is wound round the outer periphery of the outer cylinder 2*b* through spacer pieces 3*a* each having a length equal to the spacing between both wire winding flanges 2*c*, and the leakage water guide paths 3*b* are formed outwards at both transverse ends of each spacer piece 3*a*.

Since the high temperature/high pressure vessel 1 of this embodiment 1e is of a construction wherein cooling water flows through cooling water flow paths each formed between adjacent ones of spacers 6 which are interposed between the inner and outer cylinders 2*a*, 2*b*, there can be obtained the same effects as in the embodiment 1b. Additionally, by detecting the cooling water flowing out from the outer detecting groove 2*e*, it is possible to know when the sealing ring 8*c* is to be replaced. Besides, by detecting leakage water flowing out from the leakage water detecting port 10*a*, it is possible to detect a crack, if any, of the outer cylinder 2*b* and hence possible to prevent the occurrence of a serious accident.

Although in the above embodiments 1 to 1 e all of the gaps between adjacent spacers 6 are utilized as cooling water flow paths 9, it is not always necessary to do so. For example, the gaps may be utilized alternately, or there may be utilized every third gap. The mode of utilizing the gaps as cooling water flow paths 9 is not limited to the above embodiments.

Figure 8:
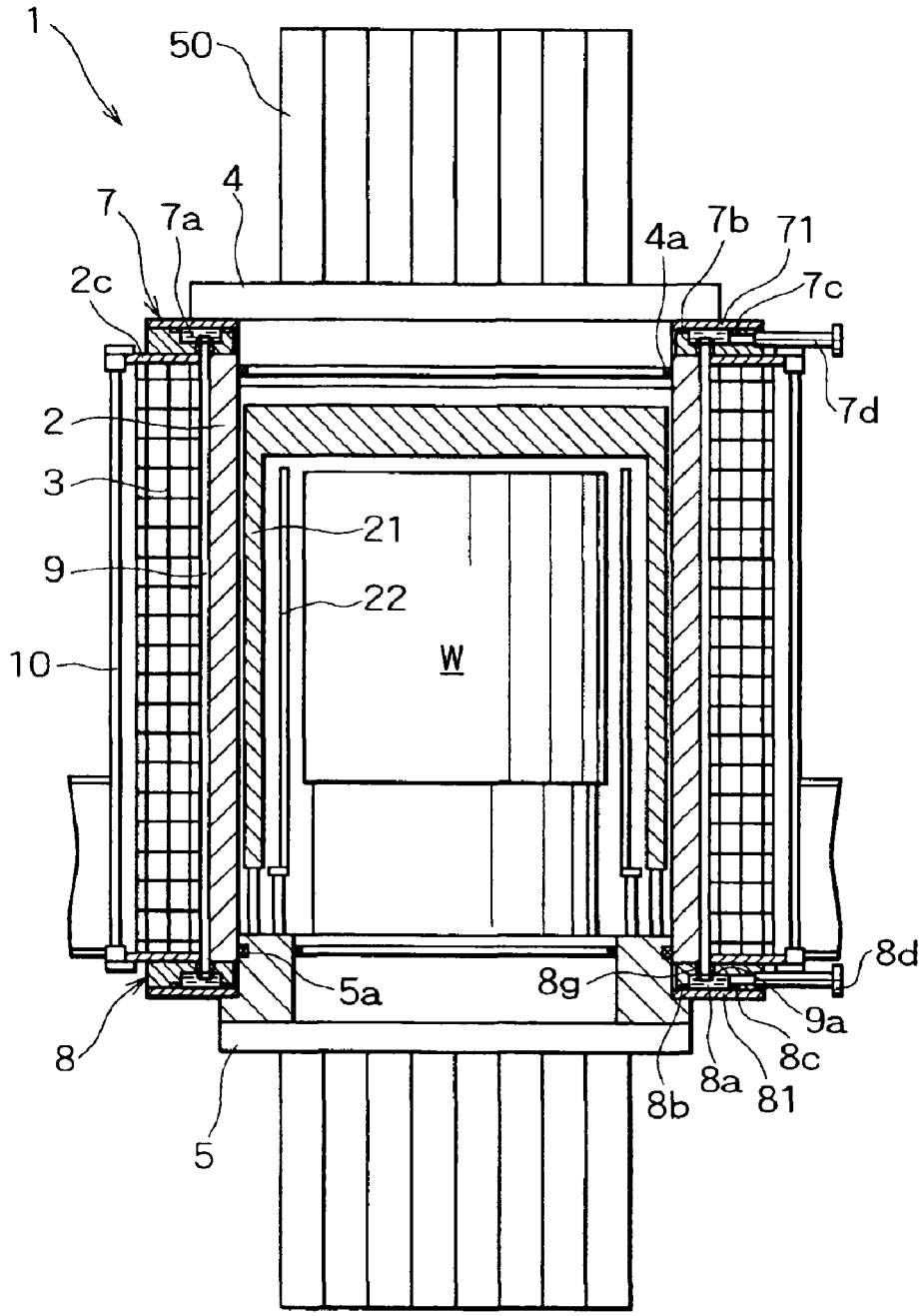
FIG. 8 is a vertical sectional view of a high temperature/high pressure vessel according to an embodiment 2 of the present invention as installed within a press frame.
Figure 9:
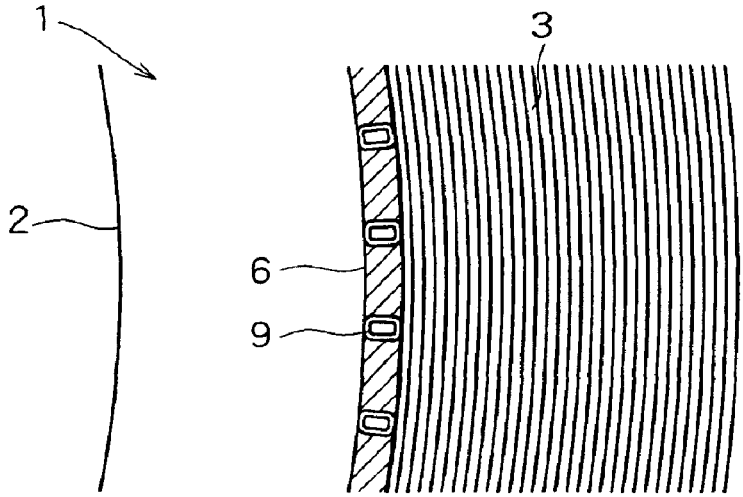
FIG. 9 illustrates a part of a cross section of the high temperature/high pressure vessel of the embodiment 2.
Figure 10:
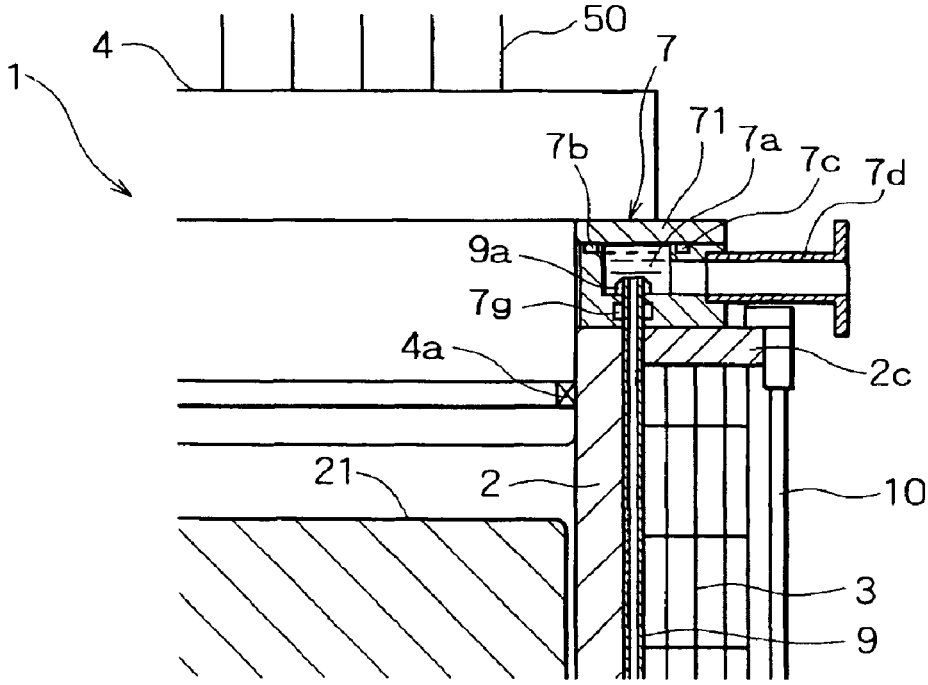
FIG. 10 is a vertical sectional view showing a part of an upper portion and the vicinity thereof of the high temperature/high pressure vessel of the embodiment 2.

A high temperature/high pressure vessel according to an embodiment 2 of the present invention will be described below with reference to the accompanying drawings. In this embodiment 2, the same components and those having the same functions as in the embodiment 1 will be identified by the same reference numerals, and a description will be given below mainly about different points. FIG. 8 is a vertical sectional view of the high temperature/high pressure vessel as installed within a press frame, FIG. 9 illustrates a part of a cross section of the high temperature/high pressure vessel, and FIG. 10 is a vertical sectional view showing a part of an upper portion and the vicinity thereof of the high temperature/high pressure vessel.

In these figures, the reference numeral 1 denotes the high temperature/high pressure vessel installed within a press frame 50 removably. The high temperature/high pressure vessel 1 is provided with a cylindrical body 2, the cylindrical body 2 having wire winding flanges 2*c* at end portions thereof respectively as is the case with the outer cylinder used in the embodiment 1. Plural spacers 6 formed as flat bars are arranged axially along an outer periphery surface of the cylindrical body 2 and at predetermined intervals in the circumferential direction, and cooling water pipes 9 are disposed each between adjacent ones of the spacers 6 and extend from one to the other end side of the cylindrical body 2. Further, piano wire 3 is wound under tension round both spacers 6 and cooling water pipes 9.

The spacers 6 and the cooling water pipes 9 are brought into close contact with the outer periphery surface of the cylindrical body 2 by being deformed with the piano wire 3 wound thereon. According to this method, heating energy for shrinkage fit is not needed and the number of working steps required is reduced. Thus, this method is superior in point of shortening of the delivery period and energy saving in comparison with the method wherein the outer cylinder is heated for shrinkage fit. In this embodiment 2, for improving the cooling performance, a high heat conductive material is filled between the outer periphery surface of the cylindrical body 2 and the cooling water pipes 9 and also between the cooling water pipes 9 and the spacers 6. As the high heat conductive material there may be used, for example, high heat conductive silicone grease (silicone compound) or silicone rubber with a high heat conductive material incorporated therein.

An annular cooling water collecting header 7 to be described later is mounted removably on an upper surface of the cylindrical body 2 and also on an upper surface of the upper wire winding flange 2*c*, while an annular cooling water supply header 8 of a construction to be described later is mounted removably on a lower surface of the cylindrical body 2 and between a lower surface of the lower wire winding flange 2*c* and a flange surface of a lower lid 5. An annular groove serving as a cooling water chamber 7*a* is formed circumferentially in the cooling water collecting header 7 and an upper opening thereof is closed with an annular lid plate 71 through sealing rings 7*b* and 7*c* so that it can be opened. Through holes are formed in a bottom plate portion of the cooling water chamber 7*a* and a sealing ring groove is formed circumferentially in the wall of each such through hole, with a sealing ring 7*g* being fitted in the sealing ring groove. Upper ends of the cooling water pipes 9 are fitted through the through holes respectively and nuts 9*a* are threadedly engaged respectively with the pipe upper ends projecting from the bottom plate portion of the cooling water chamber 7*a*.

In the cooling water supply header 8 is circumferentially formed an annular groove serving as a cooling water chamber 8*a* and a lower opening thereof is closed with an annular lid plate 81 through sealing rings 8*b* and 8*c* so that it can be opened. Through holes are formed in a bottom plate portion of the cooling water chamber 8*a* and a sealing ring groove is formed in a circumferential wall of each of the through holes, with a sealing ring 8*g* being fitted in the sealing ring groove. Upper ends of the cooling water pipes 9 are fitted through the through holes respectively and nuts 9*a* are threadedly engaged respectively with the pipe upper ends projecting from the bottom plate portion of the cooling water chamber 8*a*. According to this construction, cooling water which has entered the cooling water chamber 8*a* from a water inlet port 8*d* projecting from an outer periphery portion of the cooling water supply header 8 flows through the cooling water pipes 9 while absorbing heat from the cylindrical body 2 and is discharged to the exterior from a drain port 7*d* projecting from an outer periphery portion of the cooling water collecting header 7.

Thus, the cooling water collecting header 7 and the cooling water supply header 8 are fixed to both upper and lower end sides of the cylindrical body 2 by threaded engagement of the nuts 9*a* with end portions of the cooling water pipes 9 and are removed by removal of the nuts 9*a*. Therefore, when the sealing function of the sealing rings are deteriorated, the sealing rings can be replaced easily by removing the cooling water collecting header 7 and the cooling water supply header 8.

A description will now be given of the operation of the high temperature/high pressure vessel constructed as above. For treating the workpiece W by the high temperature/high pressure vessel 1, cooling water containing a rust preventive agent is fed from the water inlet port 8*d* into the cooling water chamber 8*a* in the cooling water supply header 8. The cooling water having entered the cooling water chamber 8*a* is here distributed equally and enters the cooling water pipes 9, then flows from below to above through the pipes 9 while undergoing heat exchange, whereby the cylindrical body 2 is cooled effectively. The cooling water which has become high in temperature by heat exchange flows into the cooling water chamber 7*a* in the cooling water collecting header 7 and is discharged to the exterior from the drain port 7*d*.

The high temperature/high pressure vessel 1 of this embodiment 2 is superior to the prior art 1 in the following points.

① Unlike the prior art 1, piano wire 3 is not wetted with cooling water, that is, piano wire does not rust which would cause breaking of the wire, and therefore a fatigue life of the piano wire 3 can be prolonged.

② There does not occur such a deformation of the cylindrical body 2 caused by winding of piano wire 3 as in the prior art 1 wherein a thin plate is interposed between rod-like spacers and piano wire. Therefore, the sealing function of sealing rings which prevent the permeation of cooling water is not lost.

Further, the high temperature/high pressure vessel 1 of this embodiment 2 is superior to the prior 2 in the following points.

① A cooling jacket is not installed within the high pressure vessel. Therefore, a heater installed within the high pressure vessel is not required to be smaller in size, nor is so required as to a workpiece, either. Thus, it is not necessary to make the high pressure vessel larger in size. This is economical.

② Unlike a cooling jacket of a two-layer construction comprising inner and outer jackets and with a refrigerant flow path formed in one of the inner and outer jackets, there is no fear of cracking in the cylindrical body 2 due to stress concentration.

In the high temperature/high pressure vessel 1 of this embodiment 2, the cooling water collecting header 7 and the cooling water supply header 8 are constructed so that both can be mounted and removed by mounting and removal of the nuts 9*a*. Therefore, there should occur the leakage of cooling water due to damage or material deterioration of the sealing rings, the sealing rings can be replaced easily by removing the headers 7 and 8, with consequent shortening of the maintenance time contributing to the improvement in availability of the HIP apparatus which uses the high temperature/high pressure vessel 1 and the reduction of maintenance cost.

Figure 11:
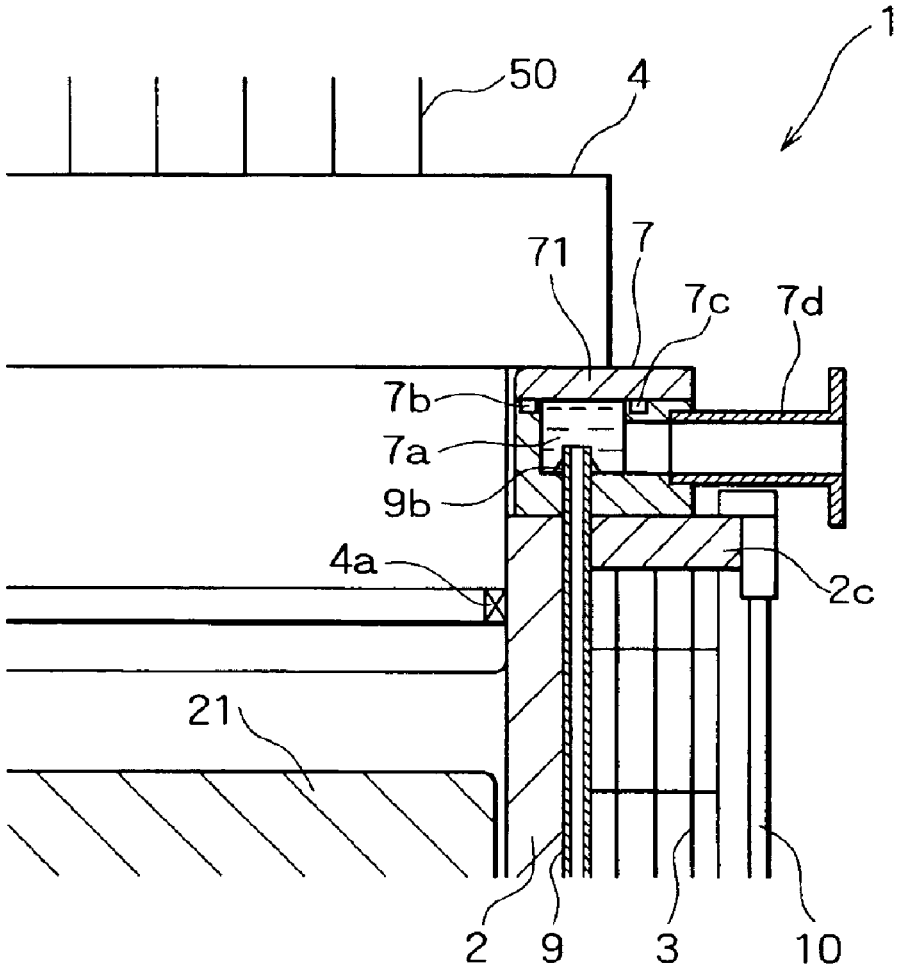
FIG. 11 is a vertical sectional view showing a part of an upper portion and the vicinity thereof of a high temperature/high pressure vessel according to an embodiment 2a of the present invention.

A high temperature/high pressure vessel according to an embodiment 2a of the present invention will be described below with reference to FIG. 11 which is a vertical sectional view showing a part of an upper portion and the vicinity thereof of the vessel. In this embodiment 2a, the same components and those having the same functions as in the embodiment 2 will be identified by the same reference numerals. However, as to a cooling water collecting header and a cooling water supply header, both are completely the same in construction, provided both are assembled in a mutually inverted state vertically. Therefore, as to the header construction, reference will be made below to the cooling water collecting header as an example.

An annular groove serving as a cooling water chamber 7*a* is formed circumferentially in a cooling water collecting header 7 and an upper opening thereof is closed with an annular lid plate 71 through sealing rings 7*b* and 7*c* so that it can be opened. Through holes are formed in a bottom plate portion of the cooling water chamber 7*a* and upper ends of cooling water pipes 9 are fitted through the through holes respectively. Further, base end portions of the pipes 9 projecting from the bottom plate portion of the cooling water chamber 7*a* are welded at 9*b* in a watertight manner.

In the high temperature/high pressure vessel 1 of this embodiment 2a, a cylindrical body 2 can be cooled by passing cooling water through the cooling water pipes 9, and the sealing rings 7*b* and 7*c* can be replaced easily by removing the annular lid plate 71.

Thus, this embodiment 2a can afford the same effects as in the embodiment 2.

Figure 12:
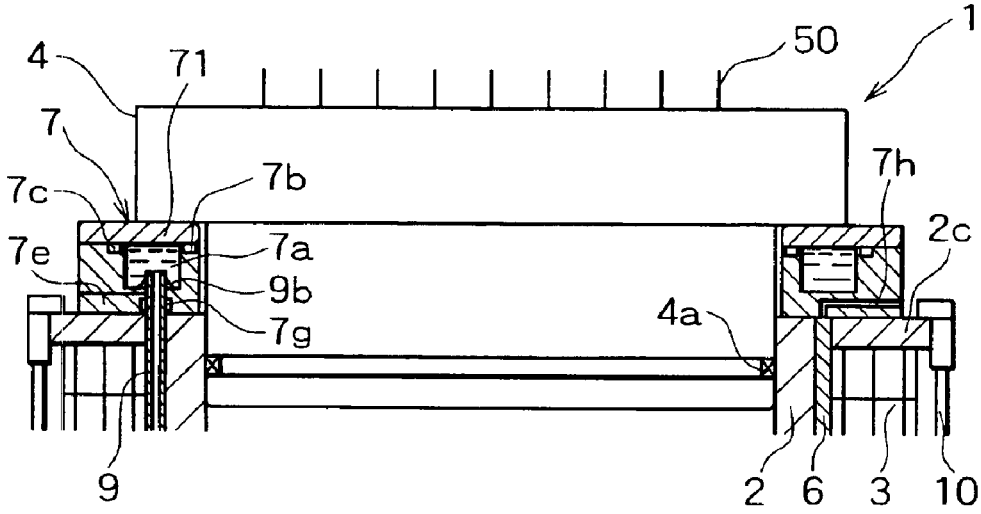
FIG. 12 is a vertical sectional view of an upper portion and the vicinity thereof of a high temperature/high pressure vessel according to an embodiment 2b of the present invention.

A high temperature/high pressure vessel according to an embodiment 2b of the present invention will be described below with reference to FIG. 12 which is a vertical sectional view of an upper portion and the vicinity thereof of the vessel. In this embodiment 2b, the same components and those having the same functions as in the embodiment 2 will be identified by the same reference numerals. However, as to the a cooling water collecting head and a cooling water supply head, both are completely the same in construction, provided both are assembled in a mutually inverted state vertically. Therefore, as to the header construction, reference will be made below to the cooling water collecting header as an example.

An annular groove serving as a cooling water chamber 7*a* is formed circumferentially in a cooling water collecting header 7 and an upper opening thereof is closed with an annular lid plate 71 through sealing rings 7*b* and 7*c* so that it can be opened. Through holes are formed in a bottom plate portion of the cooling water chamber 7*a* and a sealing ring groove is formed circumferentially in the wall of each such through hole, with a sealing ring 7*g* being fitted in the sealing ring groove. Upper ends of the cooling water pipes 9 are fitted through the through hole respectively and base end portions of the pipes 9 projecting from the bottom plate portion of the cooling water chamber 7*a* are welded at 9*b* in a watertight manner. Further, a leakage water detecting port 7*e* extends from between the sealing ring 7*g* in each of the through holes and the watertight welded portion 9*b* and communicates with an outer periphery of the cooling water collecting header 7, and there also is provided a gas detecting hole 7*h* extending from an upper end portion of each spacer 6 and communicating with the outer periphery of the cooling water collecting header 7.

According to the high temperature/high pressure vessel 1 of this embodiment 2b, the cylindrical body 2 can be cooled by passing cooling water through the cooling water pipes 9, and the sealing rings 7*a* and 7*b* can be replaced easily by removing the annular lid 71, thus affording the same effects as in the embodiment 2. Additionally, since the leakage of cooling water from the watertight welded portion 9*b* can be detected by the leakage water detecting port 7*e*, it is possible to minimize the trouble of piano wire 3 being wet with cooling water.

Further, there accrues an advantage that the occurrence of a crack in the cylindrical body 2 can be detected by the gas detecting hole 7*h*.

Figure 13:
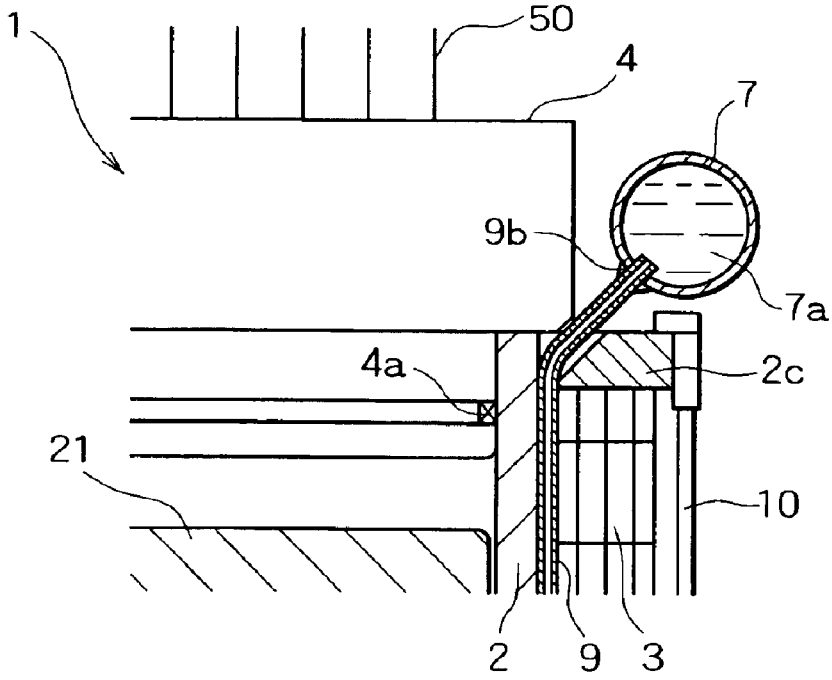
FIG. 13 is a vertical sectional view showing a part of an upper portion and the vicinity thereof of a high temperature/high pressure vessel according to an embodiment 2c of the present invention.

A high temperature/high pressure vessel according to an embodiment 2c of the present invention will be described below with reference to FIG. 13 which is a vertical sectional view showing a part of an upper portion and the vicinity thereof of the vessel. In this embodiment 2c, the same components and those having the same functions as in the embodiment 2 will be identified by the same reference numerals. However, as to a cooling water collecting header and a cooling water supply header, both are completely the same in construction, provided both are assembled in a mutually inverted state vertically. Therefore, as to the header construction, reference will be made to the cooling water collecting header as an example.

A cooling water collecting header 7 is constituted by an annular pipe, with a cooling water chamber 7*a* being formed inside the pipe. End portions of cooling water pipes 9 are bent at an angle of approximately 45°, extend respectively through through-holes formed in a base end portion of the wire winding flange 2*c* and pierce through the cooling water header 7. The piercing portion of each cooling water pipe 9 piercing through the cooling water collecting header 7 is welded at 9*b* in a watertight manner. Though not shown, a drain port is formed in the cooling water collecting header 7 formed as a pipe.

According to the high temperature/high pressure vessel 1 of this embodiment 2c, the cylindrical body 2 can be cooled by passing cooling water through the cooling water pipes 9. The position of each watertight-welded portion 9*b* is a visible position. Therefore, in the event of leakage of cooling water from the watertight-welded portion 9*b*, it is possible to remedy the water leaking portion easily and hence possible to obtain the same effects as in the embodiment 2. In addition, since the cooling water collecting header 7 is of such a simple construction as a pipe, there accrues an advantage in point of cost.

What is claimed is:

1. A high temperature/high pressure vessel for treating a workpiece placed in the interior of the vessel at a high temperature and a high pressure, said vessel comprising:

a cylindrical body, with wire wound under tension round an outer periphery of said cylindrical body; and lid members which tightly close axial openings of said cylindrical body so as to be disengageable from said openings, said cylindrical body comprising:

an inner cylinder;

a plurality of spacers arranged along an outer periphery surface of said inner cylinder; and an outer cylinder fitted on said inner cylinder through said spacers, wherein cooling water flow paths are formed each between adjacent said spacers, said cooling water flow paths extending from one end side to an opposite end side of said inner cylinder.

2. The high temperature/high pressure vessel according to claim 1, wherein, after fitted in a state of a high temperature on outer peripheries of said spacers, said outer cylinder is shrunk and deformed as the temperature drops.

3. A high temperature/high pressure vessel for treating a workpiece placed in the interior of the vessel at a high temperature and a high pressure, said vessel comprising:

a cylindrical body, with wire wound under tension round an outer periphery of said cylindrical body; and lid members which tightly close axial openings of said cylindrical body so as to be disengageable from said openings, said cylindrical body comprising:

an inner cylinder;

a plurality of spacers arranged along an outer periphery surface of said inner cylinder; and an outer cylinder fitted on said inner cylinder through said spacers, wherein cooling water flow paths are formed each between adjacent said spacers, said cooling water flow paths extending from one end side to an opposite end side of said cylindrical body, wherein said spacers are fixed to the outer periphery surface of said inner cylinder by means a clamp member fitted in each of outer grooves of the spacers and having a thickness not larger than the depth of each said outer groove, said outer grooves being formed respectively in said spacers in a direction orthogonal to the spacers.

4. A high temperature/high pressure vessel for treating a workpiece placed in the interior of the vessel at a high temperature and a high pressure, said vessel comprising:

a cylindrical body, with wire wound under tension round an outer periphery of said cylindrical body; and lid members which tightly close axial openings of said cylindrical body so as to be disengageable from said openings, said cylindrical body comprising:

an inner cylinder;

a plurality of spacers arranged along an outer periphery surface of said inner cylinder; and an outer cylinder fitted on said inner cylinder through said spacers, wherein cooling water flow paths are formed each between adjacent said spacers, said cooling water flow paths extending from one end side to an opposite end side of said cylindrical body, wherein, after fitted on outer peripheries of said spacers, said outer cylinder is shrunk and deformed by the winding of said wire, wherein said spacers are fixed to the outer periphery surface of said inner cylinder by means of a clamp member fitted in each of outer grooves of the spacers and having a thickness not larger than the depth of each said outer groove, said outer grooves being formed respectively in said spacers in a direction orthogonal to the spacers.

5. The high temperature/high pressure vessel according to claim 1, further comprising:

a cooling water supply header for the supply of cooling water to said cooling water flow paths, said cooling water supply header being disposed in a watertight manner on the one end side of said cylindrical body; and a cooling water collecting header for the collection of cooling water flowing out from said cooling water flow paths, said cooling water collecting header being disposed in a watertight manner on the opposite end side of said cylindrical body opposite to said cooling water supply header.

6. The high temperature/high pressure vessel according to claim 5, wherein said cooling water supply header and said cooling water collecting header are constructed so that they can be mounted and removed.

7. A high temperature/high pressure vessel for treating a workpiece placed in the interior of the vessel at a high temperature and a high pressure, said vessel comprising:

a cylindrical body, with wire wound under tension round an outer periphery of said cylindrical body; and lid members which tightly close axial openings of said cylindrical body so as to be disengageable from said openings, said cylindrical body comprising:

an inner cylinder;

a plurality of spacers arranged along an outer periphery surface of said inner cylinder; and an outer cylinder fitted on said inner cylinder through said spacers, wherein cooling water flow paths are formed each between adjacent said spacers, said cooling water flow paths extending from one end side to an opposite end side of said cylindrical body, wherein said wire is wound round an outer periphery of said outer cylinder through spacer pieces, with leakage water guide paths being formed transversely outwards of each said spacer piece to guide leakage water toward an end portion of said cylindrical body which leakage water leaks from said cooling water flow paths, and leakage water detecting means are provided in said leakage water guide paths.

8. The high temperature/high pressure vessel according to claim 1, wherein said spacers are flat bars.

9. A high temperature/high pressure vessel for treating a workpiece placed in the interior of the vessel at a high temperature and a high pressure, said vessel comprising:

a cylindrical body;

lid members which tightly close axial openings of said cylindrical body so as to be disengageable from said openings;

a plurality of spacers arranged along an outer periphery surface of said cylindrical body; and cooling water pipes each interposed between adjacent said spacers and extending from one end side to an opposite end side of said cylindrical body, wherein wire is wound under tension round outer peripheries of said spacers.

10. The high temperature/high pressure vessel according to claim 9, said cooling water pipes are brought into close contact with the outer periphery surface of said cylindrical body by deformation caused by the winding of said wire.

11. The high temperature/high pressure vessel according to claim 9, wherein a heat conductive material is filled between the outer periphery surface of said cylindrical body and said cooling water pipes and also between said cooling water pipes and said spacers.

12. The high temperature/high pressure vessel according to claim 9, further comprising:

a cooling water supply header for the supply of cooling water to said cooling water flow paths, said cooling water supply header being disposed in a watertight manner on the one end side of said cylindrical body; and a cooling water collecting header for the collection of cooling water flowing out from said cooling water flow paths, said cooling water collecting header being disposed in a watertight manner on the opposite end side of said cylindrical body opposite to said cooling water supply header.

13. The high temperature/high pressure vessel according to claim 12, wherein said cooling water supply header and said cooling water collecting header are constructed so that they can be mounted and removed.

14. The high temperature/high pressure vessel according to claim 9, wherein said spacers are flat bars.

* * * * *

UNITED STATES PATENT AND TRADEMARK OFFICE

CERTIFICATE OF CORRECTION

PATENT NO. : 6,960,318 B2
DATED : November 1, 2005
INVENTOR(S) : Yoneda et al.

It is certified that error appears in the above-identified patent and that said Letters Patent is hereby corrected as shown below:

Title page,
Item [73], should read:
-- Assignee: Kabushiki Kaisha Kobe Seiko Sho
(Kobe Steel, Ltd.), Kobe (JP) --.

Signed and Sealed this

Twenty-seventh Day of December, 2005

JON W. DUDAS
*Director of the United States Patent and Trademark Office*